US006338460B1

(12) United States Patent
Rumpel

(10) Patent No.: US 6,338,460 B1
(45) Date of Patent: Jan. 15, 2002

(54) LAP TYPE SIDING MOUNTED CHRISTMAS LIGHT CLIP

(76) Inventor: Donald D. Rumpel, 1957 Montgomery Gulch, Kellogg, ID (US) 83837

( * ) Notice: Subject to any disclaimer, the term of this patent is extended or adjusted under 35 U.S.C. 154(b) by 0 days.

(21) Appl. No.: 09/476,491

(22) Filed: Dec. 30, 1999

(51) Int. Cl.[7] ..... A47B 96/06

(52) U.S. Cl. ..... 248/229.16; 248/316.7; 52/28; 362/396

(58) Field of Search ..... 248/316.7, 229.13, 248/231.51, 228.4, 229.26, 230.4, 229.16; 24/553, 552, 332, 11 R, 339; 362/396, 249, 145, 806; 52/529, 530, 531, 28; D26/138; D8/395

(56) References Cited

U.S. PATENT DOCUMENTS

| | | | | | |
|---|---|---|---|---|---|
| 3,599,916 | A | * | 8/1971 | Szabo | 248/73 |
| 4,795,121 | A | | 1/1989 | Comito | 248/314 |
| D319,575 | S | | 9/1991 | Young | D8/395 |
| D325,866 | S | | 5/1992 | Gary | D8/354 |
| D365,014 | S | * | 12/1995 | Fennessy et al. | D8/371 |
| D369,957 | S | | 5/1996 | Blanton | D8/373 |
| 5,542,636 | A | | 8/1996 | Mann et al. | 248/229.26 |
| D376,535 | S | * | 12/1996 | Gary et al. | D8/395 |
| 5,581,956 | A | * | 12/1996 | Fennessy et al. | 52/28 |
| 5,607,230 | A | * | 3/1997 | Protz, Jr. | 362/396 |
| 5,609,415 | A | * | 3/1997 | Protz, Jr. | 362/396 |
| 5,680,730 | A | * | 10/1997 | Epple | 52/28 |
| 5,915,848 | A | * | 6/1999 | Deason | 52/28 |
| D422,203 | S | * | 4/2000 | Gary et al. | D8/395 |

* cited by examiner

*Primary Examiner*—Ramon O. Ramirez
*Assistant Examiner*—Gwendolyn Baxter
(74) *Attorney, Agent, or Firm*—Wells, St. John, Roberts, Gregory & Matkin P.S.

(57) ABSTRACT

A siding mounted light clip is described for releasable attachment to a lap type siding member. The clip includes a clip body with a light mount part and a siding mount part. The siding mount part includes a base member with a flange configured to slide under a lap type siding member. A leg member extends from the base member to the light mount part. A resilient clamp member is mounted to the leg member and forms an expandable siding receiving recess with the flange. A lap type siding member may be releasably gripped within the expandable siding receiving recess between the flange and resilient clamp member.

20 Claims, 5 Drawing Sheets

LAP TYPE SIDING MOUNTED CHRISTMAS LIGHT CLIP

TECHNICAL FIELD

The present invention relates to mounting of lights such as Christmas lights to structures, and particularly to lap type siding.

BACKGROUND OF THE INVENTION

It is well known to provide various forms of clips to mount strings of lights to the exterior of building structures. Most of such clip arrangements are designed for attachment to eave troughs, or they include provisions to facilitate nailing to facia boards or the like. Eave trough clips are not suitable for mounting to siding, especially to lap type aluminum, vinyl or steel siding, and the nail type clips are not preferred because of marks and indentations left by the nails. Many who decorate with light strands have therefor resigned themselves to use only eaves and perimeter structure for mounting lights. Any additional lighting is typically supported on separate forms, such as plywood sheets that are suspended, self supporting, or that can be leaned against siding without damaging the siding surface.

Placement of decorative lights is also no longer just a Christmas tradition. Many homeowners use strands of decorative lights to commemorate other holidays, or as an all season decoration.

A need has been realized for a form of light mounting clip structure that can be used on siding, to increase the decorative possibilities, and areas where decorative lights may be used.

One attempted solution to the above problems has been the use of "L" shaped light mounting brackets in which one leg of the "L" configuration fits under a siding member and the remaining leg projects outward to mount a light. Such brackets may be somewhat functional, but will easily become separated from the siding member unless nailed or otherwise secured. One example of such arrangements is disclosed in U.S. Design Patent Des. 369,957 granted on May 21, 1996 to Fred T. Blanton.

It is an objective of the present invention to provide a clip arrangement that can be used on lap type siding without damaging the siding or leaving nail marks.

It is a further objective to provide such a clip that will mount to a variety of different siding materials.

A still further objective is to provide such a clip that is simple in construction and easy to install.

The above and yet further objectives and advantages may become apparent from the following description which, taken with the drawings, describe the presently preferred mode for carrying out the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
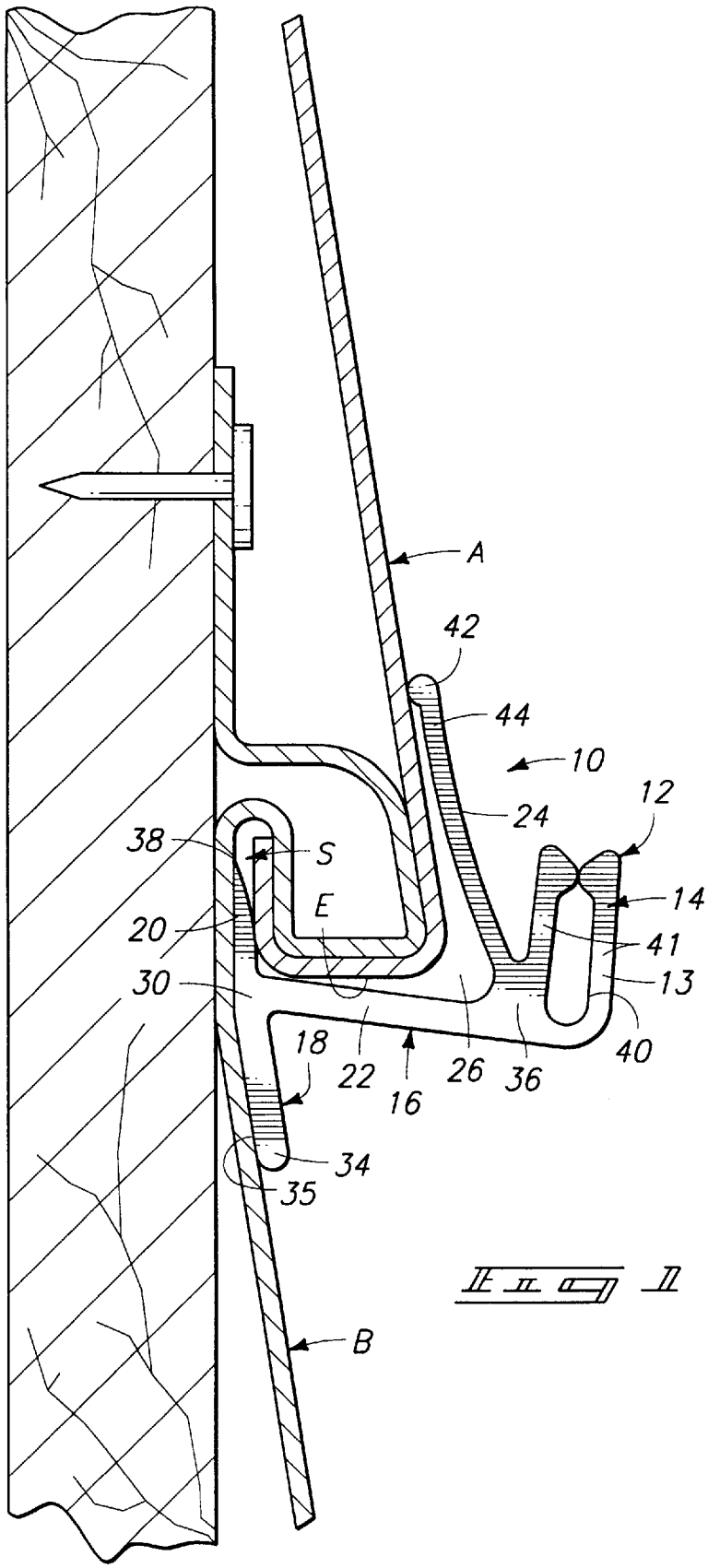
FIG. 1 is a side elevation view of a preferred clip mounted to siding, with the siding shown in cross-section.
Figure 2:
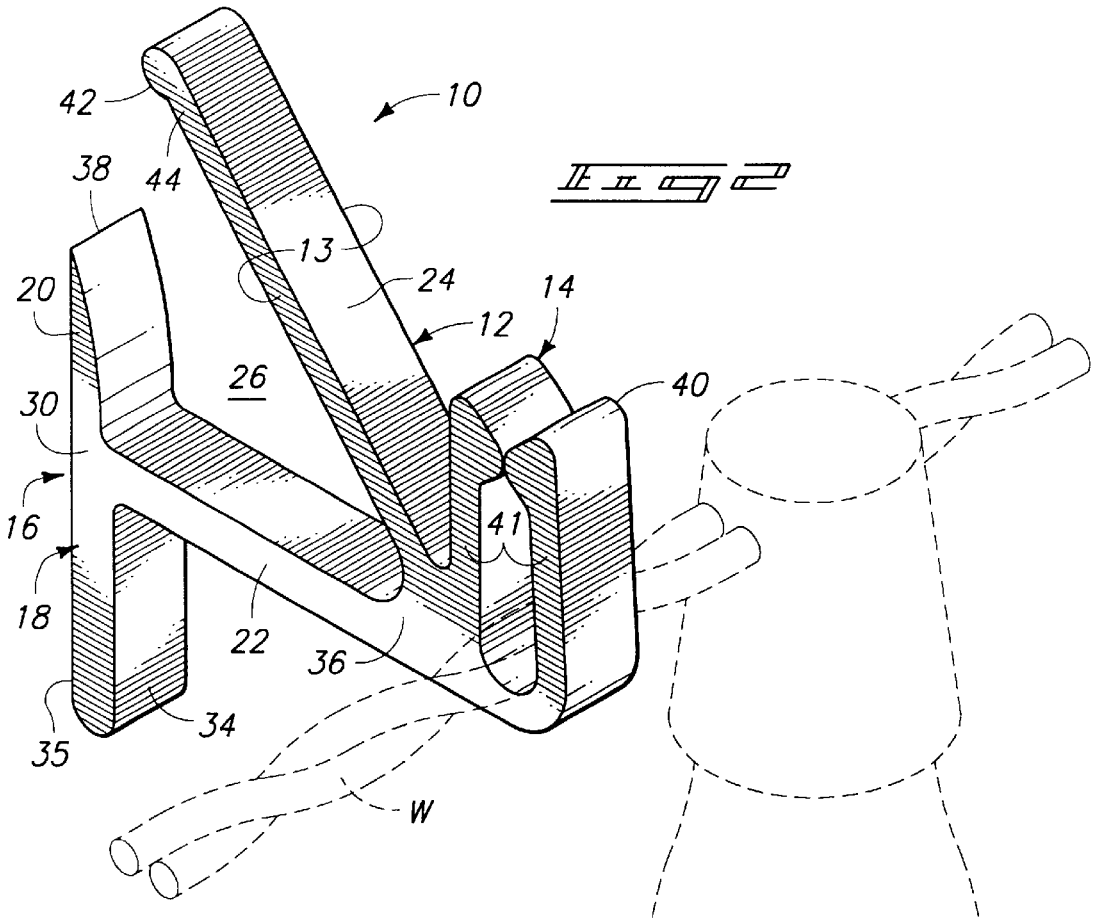
FIG. 2 is a perspective view of the preferred clip.

This disclosure of the invention is submitted in furtherance of the constitutional purposes of the U.S. Patent Laws "to promote the progress of science and useful arts" (Article 1, Section 8).

For purposes of this application, the term "siding" or "lap type siding" as used herein should be understood in broad terms to include wood, aluminum, vinyl, steel, composition or other types of lap type, shingle, shake, board and batten or other substantially rigid covering where one covering member (exemplified in the drawings as a lap type siding member A) partially overlaps another member B and leaves an accessible seam S adjacent an edge E of the member A. The term applies to such overlapping cover materials that are used primarily but not exclusively as wall coverings and roofing.

Three aspects of the invention are summarized below, followed by a more detailed description.

In a first aspect of the invention, a siding mounted light clip 10 for releasable attachment to a lap type siding member A includes a clip body 12 with a light mount part 14 and a siding mount part 16. The siding mount part 16 includes a base member 18 with a flange 20 configured to slide under the lap type siding member A. A leg member 22 extends from the base member 18 to the light mount part 14. A resilient clamp member 24 is mounted to the leg member 22 and forms an expandable siding receiving recess 26 with the flange 20. A lap type siding member A may be releasably gripped within the expandable siding receiving recess 26 between the flange 20 and resilient clamp member 24.

In another aspect, a siding mounted light clip 10 for releasable attachment to a lap type siding member includes a clip body 12 with a light mount part 14 and a siding mount part 16. The siding mount part 16 includes a "T" shaped base member 28 which includes a cross member 30 and a leg member 22. The cross member 30 includes a flange 20 and a brace member 34, with the flange 20 being configured to slide under a lap type siding member A. The leg member 22 extends to an end 36 from a point on the cross member 30 between the flange 20 and brace member 34. The light mount part 14 is located at the end 36 of the leg member 22. A resilient clamp member 24 is mounted to the leg member 22 between the light mount part 14 and flange 20 and is spaced from the flange 20 to form an expandable siding receiving recess 26 with the flange 20. A lap type siding member A may be releasably gripped between the flange 20 and resilient clamp member 24.

As a third aspect, a siding mounted light clip 10 for releasable attachment to a lap type siding member A, includes a clip body 12 including a light mount part 14 and a siding mount part 16. The clip body 12 is formed of a resilient plastic material, and the siding mount part 16 includes a "T" shaped base member 28 which includes a cross member 30 and a leg member 22. The cross member 30 includes a flange member 20 and a brace member 34. The flange member 20 is tapered to a knife edge 38 to facilitate insertion thereof under a lap type siding member A the leg member 22 extends to an end 36 from a point on the cross member between the flange and brace. The light mount part 14 is located at the end 36 of the leg member 22. The light mount part 14 is comprised of a "U" shaped clip 40 formed integrally with the leg member 22. A resilient clamp member 24 is mounted to the leg member 22 between the light mount part 14 and flange member 20 and is spaced from the flange 20 to form an expandable siding receiving recess 26 with the flange. The resilient clamp member 24 extends from the leg member 22 angularly toward the flange member 20. The clamp member 24 is elongated and includes an enlarged siding engagement bead 42 at an outward end 44. A lap type siding member A may be releasably gripped between the flange member 20 and resilient clamp member 24.

Referring now in more detail to the various aspects of the invention, attention is drawn more specifically to the drawings.

FIG. 1 of the drawings exemplifies the clip body 12 as an monolithic structure in which the light mount part 14 and the siding mount part 16 are integral. In this form, the body is preferably formed of a resilient material, preferably nylon and may be made by conventional plastic injection molding processes and machinery. Alternatively, the body 12 could be produced using conventional extrusion processes and machinery.

It may be noted from the drawings that exemplary clips 10 may be provided with opposed side surfaces 13 that are substantially parallel. Other configurations could be used, but parallel side surfaces 13 generally simplify the production processes and thereby minimize costs. The width dimension between side surfaces 13 may vary according to need, as may other dimensions of the clip 10. However, for use with conventional Christmas-type light strands, a width dimension of approximately 0.25 inches.

Figure 4:
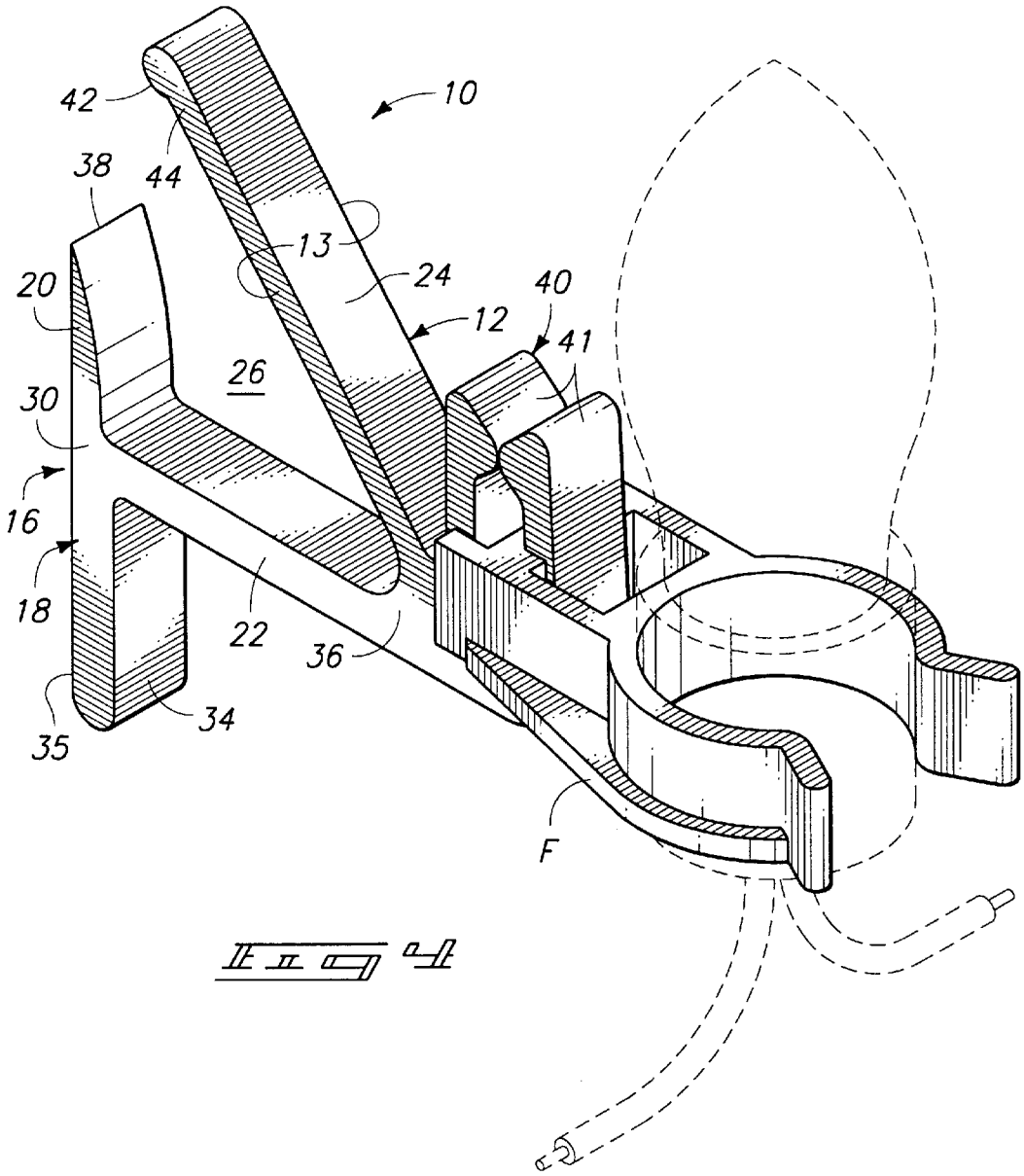
FIG. 4 is a perspective view of the clip mounting a standard size bulb clip.
Figure 5:
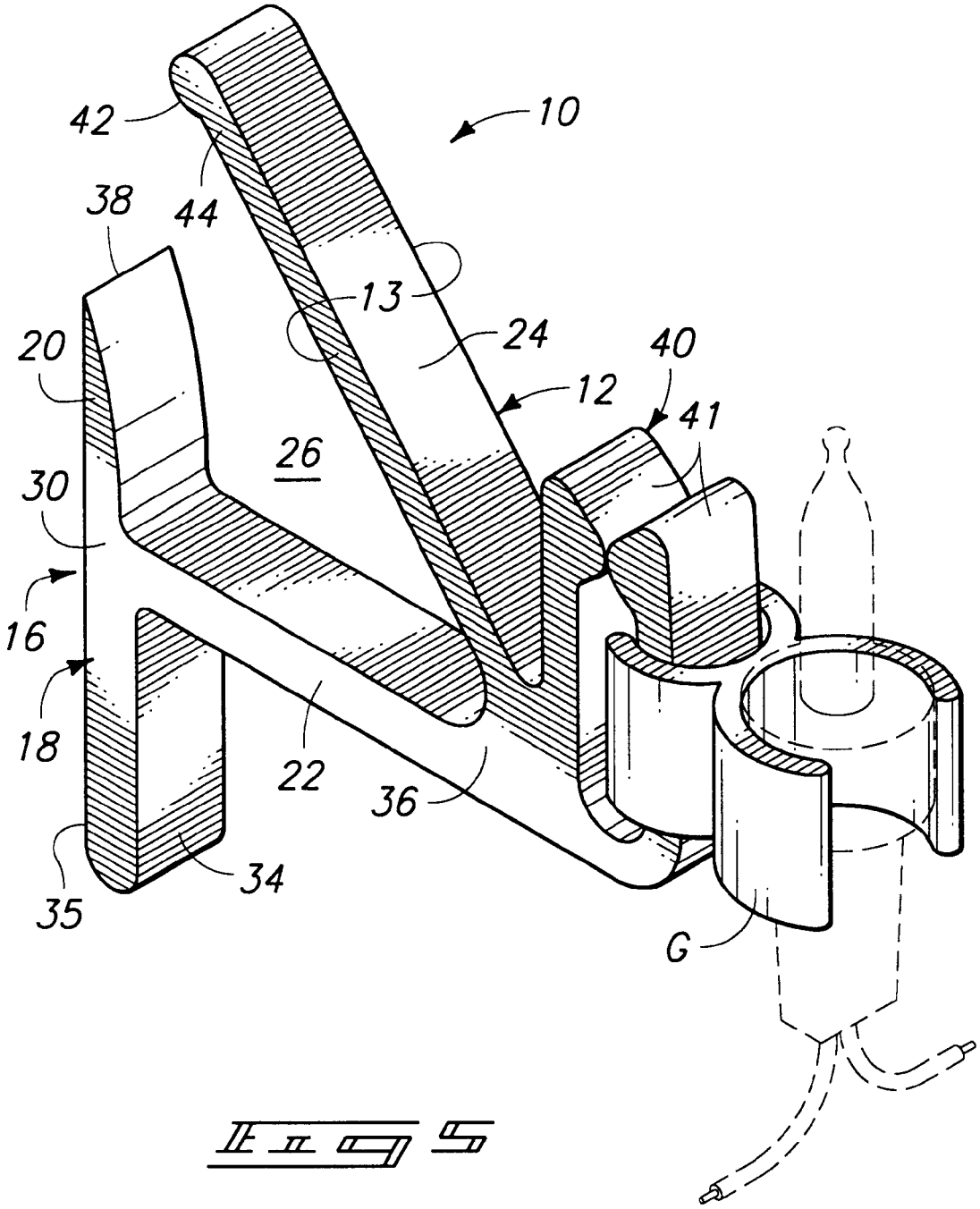
FIG. 5 is a perspective view of the clip mounting a mini light.

The light mount part 14 is preferably formed in the "U" shaped clip configuration 40, with upright spring arms 41 spaced apart to receive the lead wires W (indicated by dashed lines in FIG. 1) of a light strand. While this is a preferred use for the clip, other items may be secured by the clip 40. By way of example, FIGS. 4 and 5 illustrate utility of the clip for securing light socket mounting devices F and G that are currently on the market. The device F is used to mount standard size Christmas bulb sockets and the device G is used to mount conventional "mini" Christmas bulb sockets. Both may be easily received and held by the clip 40. Other items (not shown) may be received by the clip as well.

The clip 40 is situated in preferred forms at the end 36 of the leg member 22. Leg member 22 is part of the "T" shaped base 28 and extends from the end 36 to the cross member 30. The length of the leg member is selected to be slightly greater than a corresponding edge of a siding member A. The clips 10 may be produced with legs of varying length, depending upon the width of the siding members to be engaged. However a length of approximately 0.625 inches (between the flange 20 and clamp member 24) has been found to be sufficient for most siding configurations.

The flange 20 is preferably formed on one side of the cross member 30 and brace member 34 extends to an opposite side. Preferably the flange 20 and brace member 34 are aligned. Further, both flange 20 and brace member 34 advantageously include substantially coplanar siding engagement surfaces 35 that provide flush engagement with a siding member B (FIGS. 1 and 6) when in use.

Figure 6:
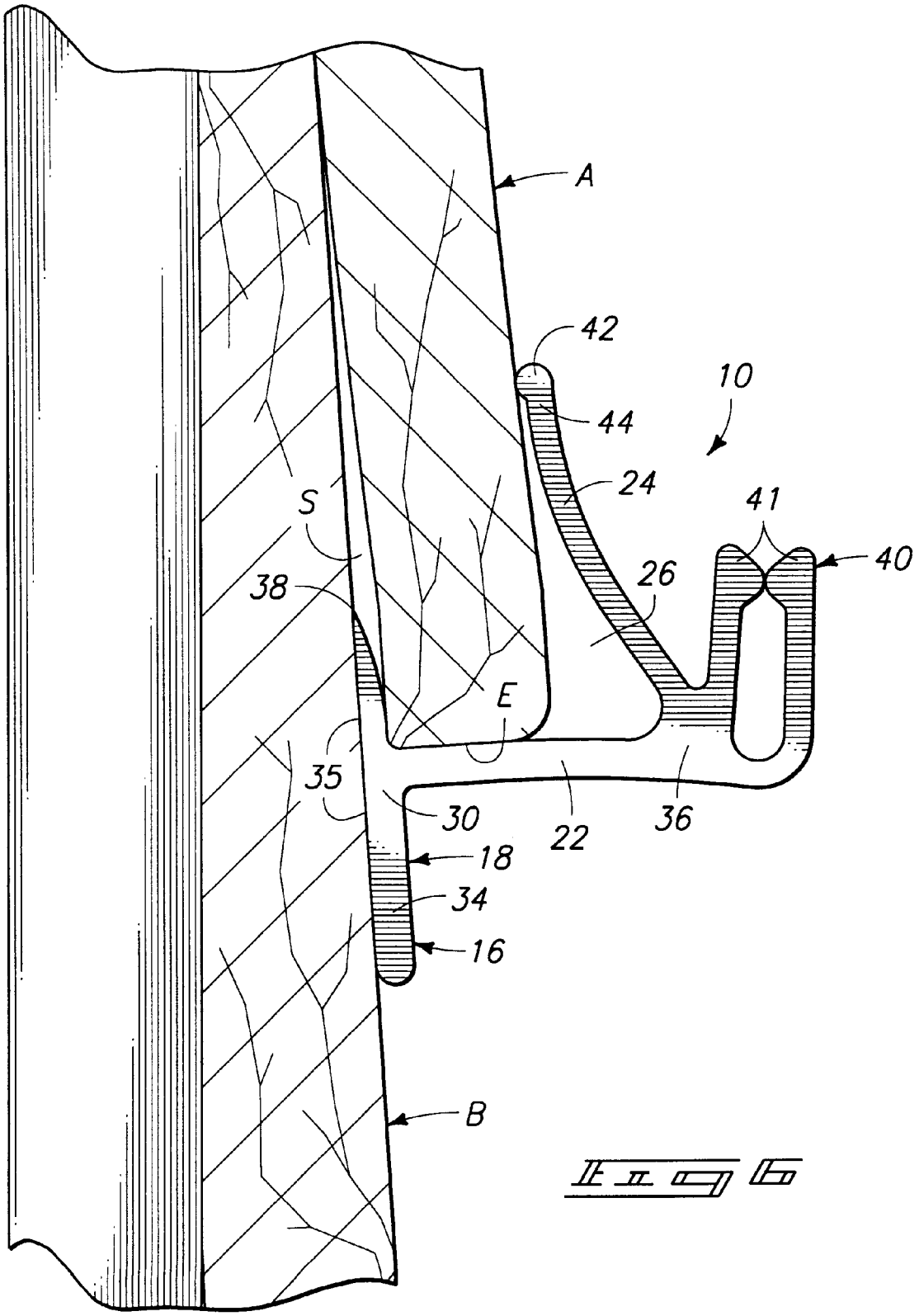
FIG. 6 is a side elevation view showing the clip mounted on wood or composite siding.

The knife edge 38 on flange 20 is preferred to facilitate insertion of the flange in situations where the siding members A, B are closely spaced or in juxtaposition. The edge 38 (which may be spaced at approximately 0.375 inches from the adjacent side of the leg member 22) allows the flange to be wedged under one member A as shown in FIGS. 1 and 6, with the surface 35 in flush engagement with the adjacent siding member B. When installed in this manner, the brace member 34 will extend along the member B to brace the clip 10 against spring action of the clamp member and hold the leg member 22 substantially horizontal (or normal to the cross member. The brace member 34 may extend approximately 0.5 inches from the adjacent side of the leg member 22, thus making the surface 35 approximately 1 inch in length for surface contact with the siding member B.

The clamp member 24 is preferably angled toward the flange member 20 to provide spring action against a siding member A when installed, to thereby clamp the member A and hold the clip in place. The clamp member will thus spring outwardly upon installation as shown in FIGS. 1 and 6, against the outward surface of the engaged siding member.

Figure 3:
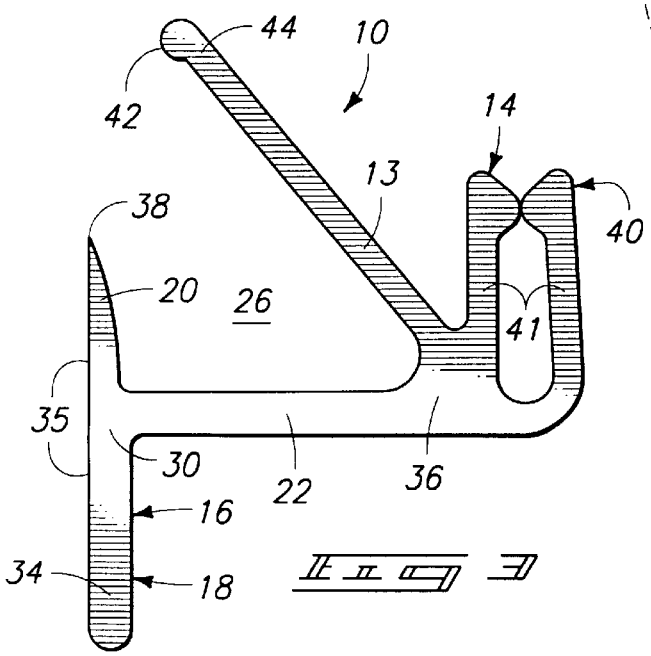
FIG. 3 is a side elevation view of the clip.

Clamp member 24 is elongated and leads angularly toward the flange 20 from a point on the leg member 22 adjacent the light mount part 14. It is spaced from the flange 20 to form the expandable siding receiving recess with the flange. The angular orientation (which may be approximately 50° from the leg member 22) is such that the distance between the flange and clamp member diminishes in a direction away from the leg member 22. Thus the preferred recess 26 is somewhat triangular as may be easily seen in FIG. 3, approximately matching the typical taper of lap siding, but to a greater degree to allow for the above mentioned spring action. The enlarged siding engagement bead 42 is situated at the outward end 44 of the clamp member to engage the siding member A at a tangential point contact, thereby minimizing the chance that the clip will mark the siding.

Given the above technical descriptions, operation of the invention may now be easily understood.

Installation of the present clip 10 is a very simple matter and requires no tools. The user simply takes the clip between the thumb and index finger and presses the enlarged bead 42 against the selected siding member A to deflect the clamp member 24 outwardly and bring the flange member into alignment with the seam S between siding members A and B. When the surface 35 comes against the adjacent siding member B, the user may simply slide the flange into the seam S between the siding members A and B, completing the installation. The siding member A is now clamped between the flange member 20 and the clamp member 24, by spring action of the clamp member 24. The user may now attach a light strand (FIG. 1), clips (FIGS. 4 and 5) or whatever he or she wishes to attach to the clip 10.

Removal of the clip 10 is also easily accomplished. The user simply grasps the clip and twists the body 12 to one side. The flange will slip out of the seam S, and the clip is free.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A siding mounted light clip for releasable attachment to a lap type siding member, comprising:

a clip body including a light mount part and a siding mount part;

wherein the siding mount part includes a base member with a flange configured to slide under the lap type siding member;

a leg member extending from the base member to the light mount part;

a resilient clamp member mounted to the leg member and forming an expandable siding receiving recess with the flange and forming an acute angle to the leg member and to the light mount part; and whereby the lap type siding member is adapted to be releasably gripped within the expandable siding receiving recess between the flange and resilient clamp member.

2. A siding mounted light clip as defined by claim 1 wherein the clip body is formed of a resilient material.

3. A siding mounted light clip as defined by claim 1 wherein the clip body is formed of nylon.

4. A siding mounted light clip as defined by claim 1 wherein the base member includes a brace member substantially aligned with the flange.

5. A siding mounted light clip as defined by claim 1 wherein the resilient clamp member leads angularly toward the flange from a point on the leg member adjacent the light mount part.

6. A siding mounted light clip as defined by claim 1 wherein the light mount part is comprised of a "U" shaped clip formed integrally with the leg member.

7. A siding mounted light clip as defined by claim 1 wherein the resilient clamp member leads angularly toward the flange from a point on the leg member adjacent the light mount part; and wherein the light mount part is comprised of a "U" shaped clip formed integrally with the leg member.

8. A siding mounted light clip as defined by claim 1 wherein the resilient clamp member leads angularly toward the flange from a point on the leg member adjacent the light mount part;

wherein the light mount part is comprised of a "U" shaped clip formed integrally with the leg member; and wherein the base member includes a brace member substantially aligned with the flange.

9. A siding mounted light clip as defined by claim 1 wherein the flange member is tapered to a knife edge to facilitate insertion thereof under the lap type siding member.

10. A siding mounted light clip as defined by claim 1 wherein the flange member is tapered to a knife edge to facilitate insertion thereof under the lap type siding member; and wherein the base member includes a brace member substantially aligned with the flange.

11. A siding mounted light clip for releasable attachment to a lap type siding member, comprising:

a clip body including a light mount part and a siding mount part;

wherein the siding mount part includes a "T" shaped base member which includes a cross member and a leg member;

wherein the cross member includes a flange and a brace member, with the flange being configured to slide under the lap type siding member;

wherein the leg member extends to an end from a point on the cross member between the flange and brace member;

wherein the light mount part is located at the end of the leg member; and a resilient clamp member mounted to the leg member between the light mount part and flange and oriented at an acute angle with the leg member and light mount part to form an expandable siding receiving recess with the flange;

whereby the lap type siding member is adapted to be releasably gripped between the flange and resilient clamp member.

12. A siding mounted light clip as defined by claim 11 wherein the flange member is tapered to a knife edge to facilitate insertion thereof under the lap type siding member.

13. A siding mounted light clip as defined by claim 11 wherein the clip body is formed of a resilient plastic material.

14. A siding mounted light clip as defined by claim 11 wherein the clip body is formed of nylon.

15. A siding mounted light clip as defined by claim 11 wherein the resilient clamp member is elongated and extends angularly from the end of the leg member toward the flange.

16. A siding mounted light clip as defined by claim 11 wherein the light mount part is comprised of a "U" shaped clip formed integrally with the leg member.

17. A siding mounted light clip as defined by claim 11 wherein the flange member and brace member include substantially coplanar siding engagement surfaces.

18. A siding mounted light clip as defined by claim 11 wherein the clamp member is elongated and includes an enlarged siding engagement bead at an outward end.

19. A siding mounted light clip for releasable attachment to a lap type siding member, comprising:

a clip body including a light mount part and a siding mount part;

wherein the clip body is formed of a resilient plastic material;

wherein the siding mount part includes a "T" shaped base member which includes a cross member and a leg member;

wherein the cross member includes a flange member and a brace member;

wherein the flange member is tapered to a knife edge to facilitate insertion thereof under the lap type siding member;

wherein the leg member extends to an end from a point on the cross member between the flange and brace;

wherein the light mount part is located at the end of the leg member;

wherein the light mount part is comprised of a "U" shaped clip formed integrally with the leg member a resilient clamp member mounted to the leg member between the light mount part and flange and is oriented at an acute angle to the leg member and light mount part to form an expandable siding receiving recess with the flange;

wherein the resilient clamp member extends from the leg member angularly toward the flange member;

wherein the clamp member is elongated and includes an enlarged siding engagement bead at an outward end;

whereby the lap type siding member is adapted to be releasably gripped between the flange and resilient clamp member.

20. A siding mounted light clip as defined by claim 19 wherein the flange member and brace member include substantially coplanar siding engagement surfaces.

* * * * *